US007207437B1

(12) United States Patent
Johansson

(10) Patent No.: US 7,207,437 B1
(45) Date of Patent: Apr. 24, 2007

(54) AIRTIGHT PAINT BRUSH JACKET

(76) Inventor: Erik G. Johansson, 32 Fletcher St., Kennebunk, ME (US) 04043

( * ) Notice: Subject to any disclaimer, the term of this patent is extended or adjusted under 35 U.S.C. 154(b) by 0 days.

(21) Appl. No.: 11/271,221

(22) Filed: Nov. 12, 2005

(51) Int. Cl.
*B65D 39/14* (2006.01)
*A45D 44/18* (2006.01)

(52) U.S. Cl. ..... 206/15.3; 206/361

(58) Field of Classification Search ..... 206/209, 206/349, 361, 362.2, 362.3, 15.2, 15.3; 15/143.1, 15/168, 246, 247, 248.1, 249.1
See application file for complete search history.

(56) References Cited

U.S. PATENT DOCUMENTS 2,262,753 A * 11/1941 Brennan ..... 206/15.3
2,782,909 A * 2/1957 McNamara ..... 206/15.3
4,751,762 A * 6/1988 Meimeteas ..... 206/361
4,847,939 A * 7/1989 Derencsenyi et al. ..... 206/361
5,992,617 A * 11/1999 Couch et al. ..... 206/15.3
6,213,329 B1 * 4/2001 Dobson ..... 206/15.3
6,494,315 B2 * 12/2002 Frisk ..... 206/15.3

* cited by examiner

*Primary Examiner*—Luan K. Bui
(74) *Attorney, Agent, or Firm*—William F. Hamrock, PA

(57) ABSTRACT

An air tight paint brush jacket is provided which seals a wet paint brush in its wet condition from drying out until its next use. The jacket is composed of a sleeve and boot prepared from an elastomeric sheath. The sleeve provides an inverted U-shaped body having an upwardly extending neck which frictionally and rigidly seals the brush handle. A shoulders section and a ferrule section of the sleeve firmly engages the brush shoulders and ferrule portions of the brush. An expanded bristles section loosely contains the bristles portion of the brush. The boot is hengedly attached to the sleeve and is structured to securely engage the entire jacket in an air tight seal. The frictionally engaged neck and form fitting neck, shoulders and ferrule firmly engage the brush handle, shoulders and ferrule portions to support the enclosed brush in an upright position and the loosely contained bristles portion preserves the bristles in its painting condition.

10 Claims, 3 Drawing Sheets

AIRTIGHT PAINT BRUSH JACKET

BACKGROUND OF THE INVENTION

The invention relates to a jacket of a sleeve and boot for paint brushes, and in particular, to an elastomeric sleeve having firmly engaging upper brush body section and loosely fitting expanding lower bristles section, and to a rigidly secured removable boot for storing brushes wet with paint for periods of time by firmly supporting the brush upper body in an upright position and loosely containing the bristles preventing the bristles from sticking together, clogging, bending, in an airtight system and preserving the moist wet paint bristles structure for immediate use without requiring cleaning the paint from the bristles.

The typical paint brush of various sizes commonly used, and to which the present invention is directed, is an inverted U-shaped portion of bristles secured to a ferrule portion attached to a shoulder portion which is attached to an upstanding handle as indicated in the drawings. After use the brush must be cleaned with water or solvent, depending on whether a water based paint or solvent based paint is being used. This cleaning requires a considerable amount of time and effort to return the bristles to paintable condition. If not cleaned, the wet paint dries on the bristles resulting in clogging, stiffening and bending of the bristles making the brush unuseable for further painting.

Various types of devices for protecting paint brushes are known. Some of these devices include plastic materials in an attempt to cover the bristles portion, ferrule portion, shoulder portion and attach to the handle. However, none of these devices provides an elastomeric jacket which forms a rigid, airtight seal at its top opening on the handle and at its bottom boot enclosure, firmly engages the upper shoulders and ferrule portions while loosely containing the bristles portion in an unpressured, wet, unclogged, straight dangling position which completely encases the brush standing upright in an air tight system.

SUMMARY OF THE INVENTION

In accordance with the present invention a jacket of an elastomeric sleeve and boot is provided for protecting a wet paint brush from drying out until its next use. The elastomeric sleeve and boot of the invention is composed of a resilient rigid elastomeric sheath. Elastomeric sheaths of each polysilicone or polyurethane have been found which have the unique fabrication properties in providing the combination upper form fitting and lower expandable unpressured sheath required for the jacket of this invention. For a conventional two inch wide brush, an elastomeric sheath about one eight inch in thickness has been most suitable in providing the strength and stability of the jacket. The sheath forms an inverted U-shape hollow body having a top neck opening and a bottom brush opening for the brush to pass through. The boot is hengedly attached to the sleeve. The neck frictionally engages the brush handle forming an air tight seal by means of an outwardly extending interior ridge ring of reduced diameter which frictionally and rigedly engages the brush handle. Integral form fitting sheath sections firmly encase the brush handle shoulders and ferrule portions of the brush. An integral expanded sheath section extending downwardly loosely contains the unpressured and loosely hanging bristles portion of the brush and extends beyond the bottom of the bristles portion forming a bottom brush opening for inserting the brush up through the sheath. A sheath boot is hengedly attached to the bottom of the sleeve and is structured to securely engage and seal the bottom opening forming an enclosed open space below the bottom of the bristles resulting in an air tight jacket of the elastomeric sleeve and boot. It is these resilient and rigid properties of the elastomeric sheath which provides for the jacket firmly enclosed brush to stand upright.

BRIEF DESCRIPTION OF THE DRAWINGS

The invention is described by the appended claims in relation to the description of the preferred embodiment with reference to the following drawings which are explained briefly as follows:

PARTS LIST

Figure 1:
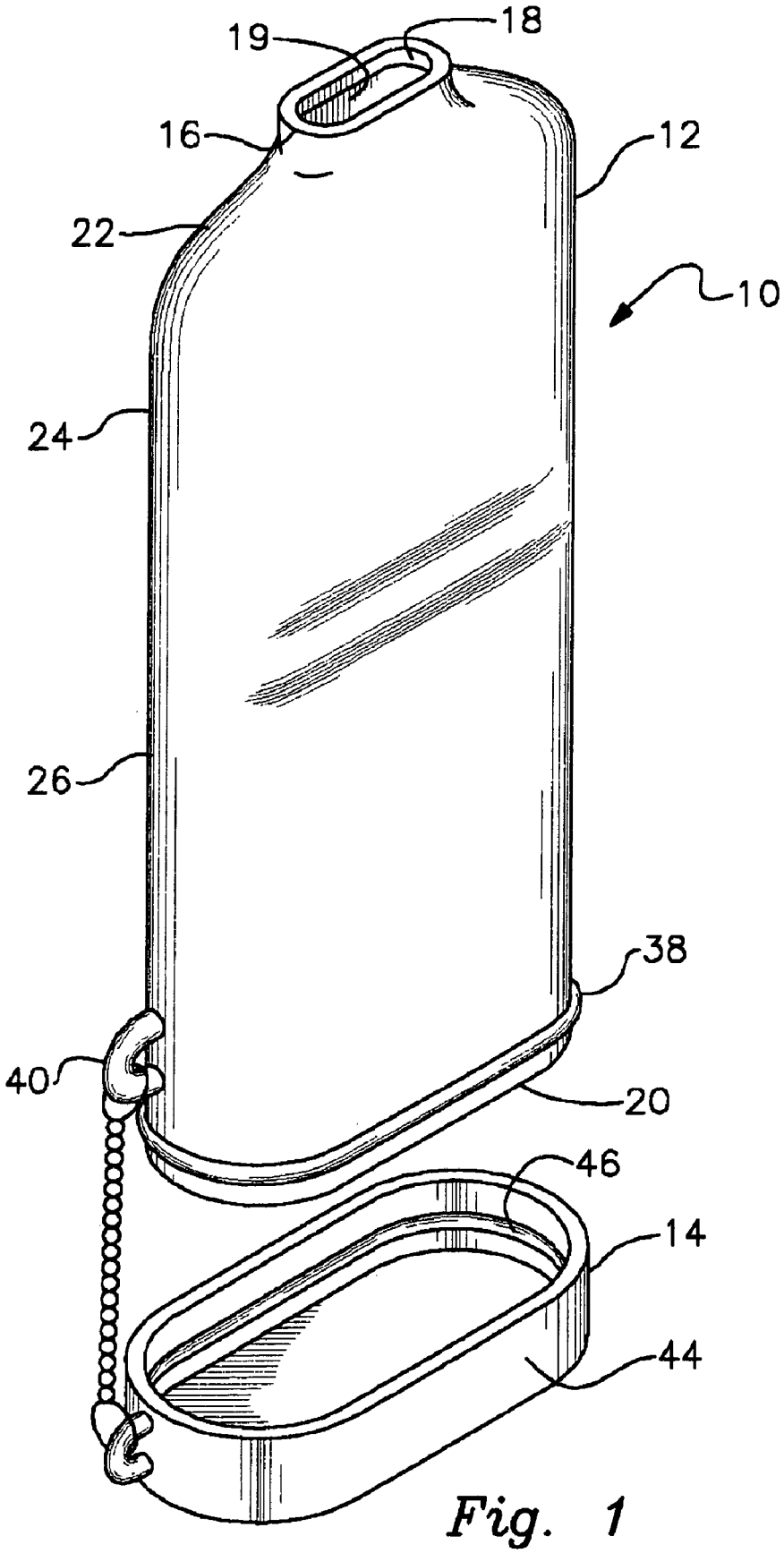
FIG. 1 is a perspective view of the elastomeric sleeve and boot of the invention.

The following numbered elements are listed in the drawings.

10 Jacket
12 Sleeve
14 Boot
16 Neck
18 Ridge ring
19 Neck opening
20 Brush opening
22 Shoulders section
24 Ferrule section
25 Ferrule walls
26 Bristles section
27 Bristles walls
28 Brush
30 Handle
32 Shoulders
34 Ferrule
36 Bristles
38 Rib
40 U-shaped arm
42 Truss
44 Boot walls
46 Boot interior ring

DESCRIPTION OF THE PREFERRED EMBODIMENT

The present invention provides a jacket of an elastometric sleeve and a boot for sealing and preserving a wet paint brush in wet painting condition until its next use. This is accomplished by the present air tight system which keeps the brush enclosed in the jacket by being secured in an upper form fitting sleeve sections and loosely contained in a lower expanded sleeve bristles section sealed and locked in an air tight system by the boot.

Referring to FIG. 1, jacket 10 includes an elastomeric sleeve 12 and boot 14 composed of an elastomeric sheath preferably about one eight of an inch in thickness. The preferred elastomeric sheets of either polyurethane or polysilicone have provided the unique fabrication properties of forming continuous upper compact form fitting and lower expandable loosely fitting sheath required for the jacket of this invention. The one eight of an inch thickness of the sheath was found to meet the requirements of the present jacket for conventional two inch wide brushes but for larger brushes a slight increase in thickness would be required. The elastomeric sheath is capable of forming continuous form fitting and loosely fitting sections forming a compact and loose enclosure which preserves the encased brush upright in a sealed condition and loosely contained bristles in paintable condition. It is this compact and loose enclosure of the form fitting upper sheath sleeve sections which firmly engages the brush handles shoulders and ferrule portions to support the brush in an upright position, and the continuous lower expanded sheath sleeve bristles section to loosely contain the bristles that create the expanded enclosure of the jacket preserving the brush in its painting condition.

As seen in FIG. 1, elastomeric sleeve 12 includes a generally inverted U-shaped hollow sleeve having neck 16 with an interior reduced diameter ridge ring 18 at the neck opening 19 at its upper end and brush opening 20 at its lower end. Neck 16 is continuous with shoulders section 22 which is integral with ferrule section 24 integral with bristles section 26 forming bottom brush opening 20. Boot 14 is hengedly attached to the bristles section 26.

Figure 2:
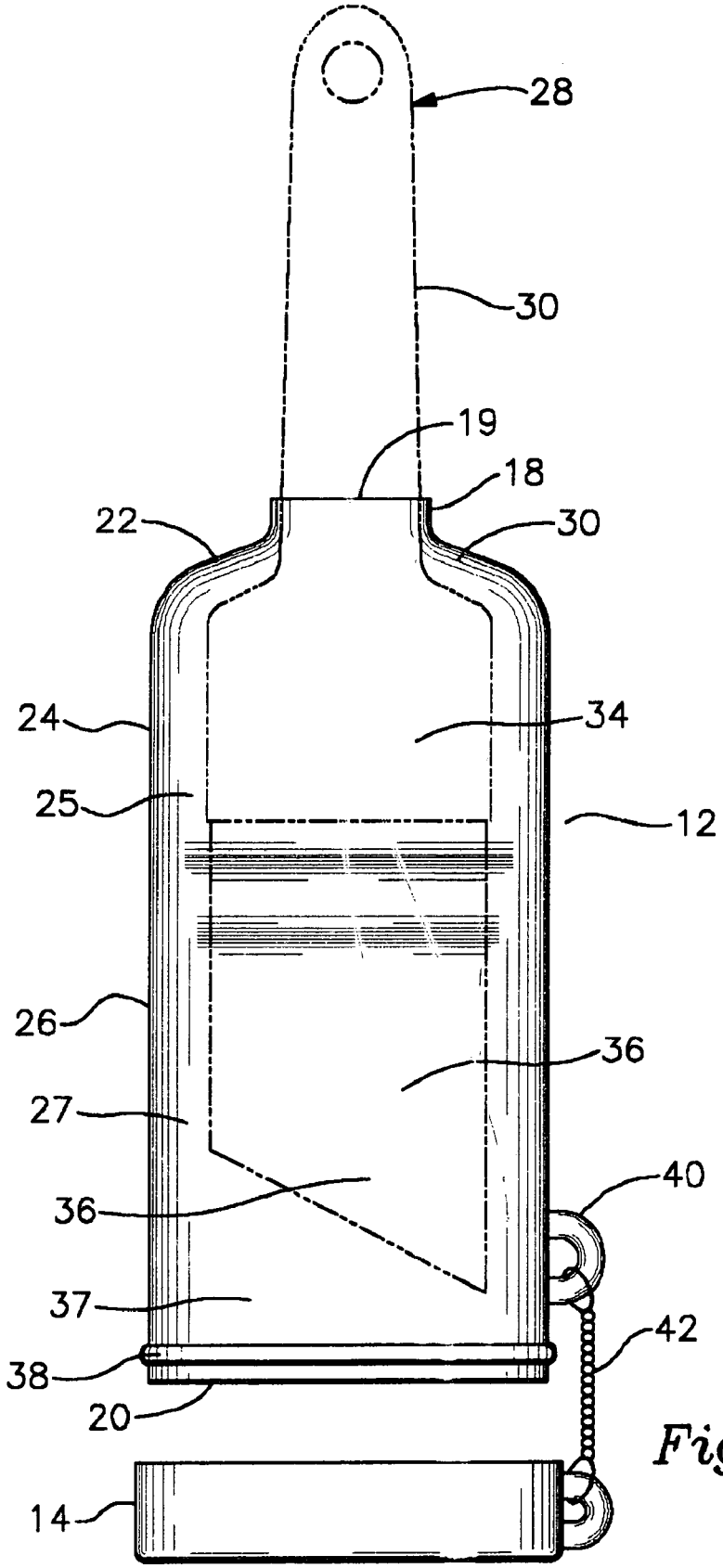
FIG. 2 is a view of the brush sealed in the sleeve and the hingedly attached boot.

Shown in FIG. 2, brush 28 extends upwardly at the neck through bottom brush opening 20 and is encased in the sleeve 12. Neck 16 by means of reduced diameter ridge ring 18 at neck opening 19 is tightly structured to frictionally engages handle 30 forming an air tight gripping seal connection. Shoulder section 22 is tightly constructed to firmly engage shoulders 30 continuous with ferrule sections 24 front and rear walls 25 which are tightly constructed to family engage the ferrule brush portion 34. The structure of the sleeve at this point is expanded providing the continuous bristles section 26 front and rear walls 27 expanded to loosely contain the bristles 36 portion and to extend downwardly to about one half an inch below the end of bristles 36 portion forming a bottom open area 37 below the bristles within the connected boot and sleeve. A boot connecting rib 38 completely encircles the bottom exterior surface of the sleeve. A closed U-shaped arm 40 is attached to the lower exterior surface of the sleeve to which boot 14 is suspended by means of truss 42.

Figure 3:
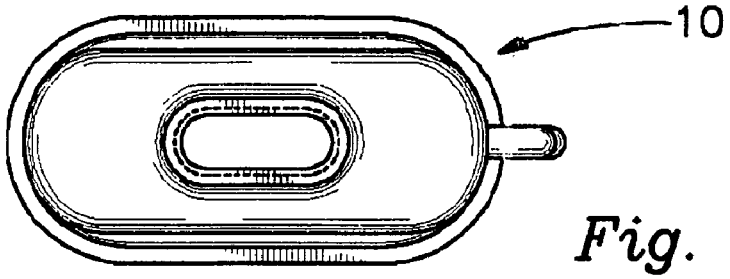
FIG. 3 is a top view of the jacket and shoe.

The top view of the jacket with the boot firmly clamped to the bristles section is shown in FIG. 3. As seen in FIGS. 1 and 2, boot 14 has an open, cup base structured to firmly clamp and enclose the bottom of the sleeve and open area 37 below the bristles providing an air tight Jacket. Boot walls 44 include an interior open ring 46 which tightly engages sleeve rib 38 clamping the boot in place. It is these resilient and rigid properties of the elastomeric sheath which provide for the jacket firmly enclosed brush in its airtight jacket to stand upright. The combined connections of ridge ring 18 to the brush handle and of the boot wall interior ring 46 engaging rib 38 of the sheath securely encloses the brush in an airtight system.

Figure 4:
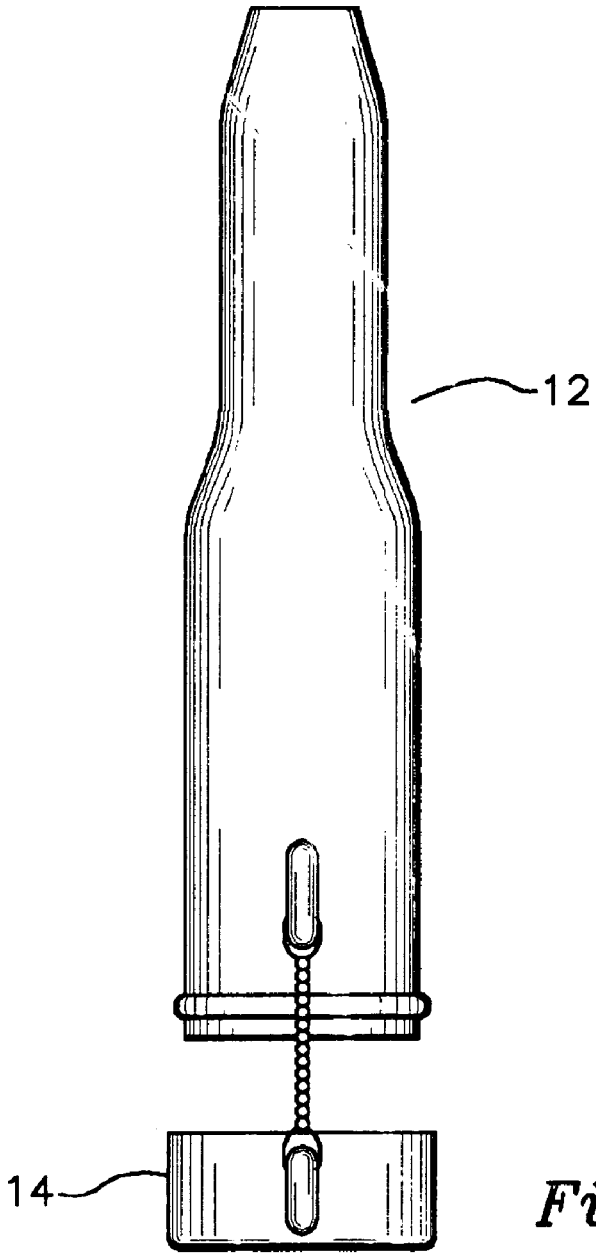
FIG. 4 is a side view of the jacket showing the contour of the compressed upper sections and the expanded lower bristles section.

Shown in FIG. 4 is the side view of the jacket with the hengedly attached boot 14 showing the contour of the structure of sleeve 12. It is the compact form fitting neck upper sheath sleeve shoulders section, ferrule section which support the enclosed brush in an upright position. It is the lower expanded sheath sleeve bristles section which loosely contour the bristles creating the expanded enclosure of the jacket preserving the brush in its painting condition.

While the invention has been illustrated and described in detail in the drawings and foregoing description, the same is to be considered as illustrive and not restrictive in character, it being understood that only the preferred embodiments have been shown and described and that all changes and modifications that come within the spirit of the invention are desired to be protected.

What is claimed is:

1. An air tight paint brush jacket of a sleeve and boot which seals a wet paint brush in its wet condition, the brush having an upright handle, shoulder portion, ferrule portion and downwardly extending bristles portion enclosed within the jacket, comprising:

the sleeve and boot made of elastomeric sheaths, said brush sleeve providing an inverted U-shaped body having an upwardly extending neck with a top opening extending from a shoulders section, which continues downwardly to a ferrule section having front and rear walls, which extends downwardly to a bristles section having front and rear walls forming a bottom brush opening, said neck at its opening frictionally and rigidly engages the sleeve to the brush handle in an air tight seal, said shoulders section being tightly structured firmly engages the brush shoulders portion, said ferrule section front and rear walls being tightly structured firmly engages the brush ferrule portion, said bristles section front and rear walls being structurally expanded loosely contains the unpressured brush bristles portion and extends downwardly below the bristles portion forming a bottom wide open area, said boot hingedly attached to the sleeve and structured to securely engage the bristles section and enclose the bottom open area and sleeve in an air tight seal.

2. The air tight brush jacket according to claim 1 wherein said neck at its opening has an interior reduced diameter ridge ring.

3. The air tight brush jacket according to claim 2 wherein the ridge ring frictionally and rigedly engages the brush handle.

4. The air tight brush jacket according to claim 1 wherein an exterior rib encircles the exterior of the sleeve bristles portion.

5. The air tight brush jacket according to claim 4 wherein the boot comprises a open flat base encircled by an upstanding wall.

6. The air tight brush jacket according to claim 5 wherein the boot is attached to the exterior of the sleeve bristles portion by an intrical hinge.

7. The air tight brush jacket according to claim 6 wherein the boot has an interior ring which engages the sleeve rib.

8. The air tight brush jacket according to claim 1 wherein the elastomeric sheaths are elastomeric sheaths of polyurethane.

9. The air tight brush jacket according to claim 1 wherein the elastomeric sheaths are elastomeric sheaths of polysilicone.

10. The air tight brush jacket according to claim 1 wherein the elastomeric sheaths are about one eight of an inch in thickness.

* * * * *